United States Patent [19]

Camps

[11] 4,036,413

[45] July 19, 1977

[54] CONTAINER CLOSURE CONSTRUCTION

[75] Inventor: Jean Bernard Camps, Sao Paulo, Brazil

[73] Assignee: Perticamps S.A.Embalagens, Brazil

[21] Appl. No.: 679,686

[22] Filed: Apr. 23, 1976

[30] Foreign Application Priority Data

Oct. 27, 1975 Brazil ..... 13500842

[51] Int. Cl.[2] ..... B65D 41/62

[52] U.S. Cl. ..... 222/500; 222/522

[58] Field of Search ..... 222/500, 522, 546, 571, 222/525

[56] References Cited

U.S. PATENT DOCUMENTS 2,829,807 4/1958 Kirschenbaum ..... 222/546 X

*Primary Examiner*—Stanley H. Tollberg
*Assistant Examiner*—Hadd Lane
*Attorney, Agent, or Firm*—McGlew and Tuttle

[57] ABSTRACT

A container closure construction comprises a container which has an externally threaded neck portion, with a top opening and with a rim encircling the opening and with a cap bead receiving recess defined below the rim around the exterior of the neck portion. The closure includes an inner closure cap having a cap part which overlies the container opening and an annular side skirt portion which is engaged around the exterior of the container neck portion, and which includes an inwardly extending cap bead engaged in a cap receiving recess of the container. A hollow central part extends through this cap part which goes above the exterior face and below the interior face and it defines an opening therethrough. An outer cover has an internally threaded outer cover skirt part which threadably engages with the externally threaded neck portion of the container. In addition the outer cover has a top cap ledge wall which overlies the rim and is engageable over the top cap part and it also has a central raised cap part extending to a level above the ledge wall and an overlying the hollow cylindrical part. A stopper projection is defined on the raised cap part and it is engageable into the hollow cylindrical part, preferably with a wedging fit. A stopper is captured within the cylindrical part and it includes a lower flat disc portion which forms a stop for a movable cylindrical retaining ring.

4 Claims, 2 Drawing Figures

CONTAINER CLOSURE CONSTRUCTION

FIELD AND BACKGROUND OF THE INVENTION

This invention relates in general to the construction of container closures, and in particular to a new and useful container closure, which includes an inner closure cap which is snap-fitted onto the neck of a container so as to cover the rim and which carries a cylindrical central portion which is engaged by a stopper part of an outer cover which is threaded onto the exterior of the container.

DESCRIPTION OF THE PRIOR ART

The present invention relates particularly to a container of a type which has a stopper, and particularly for bottles or vials essentially for ready-made sauces or gravies such as English sauce, ketchup, peppered sauces, etc. For such a purpose the cover and the stopper design are of extreme importance because it is required for liquids of a relatively viscous nature, and which require a dosing application nevertheless. A disadvantage of the known closures is that they are not easily usable for dispensing a viscous liquid without contaminating the outlet or permitting uneven or a too abundant or too small a dosing. In addition they have a tendency to provide grooves and recesses which become contaminated with the material.

SUMMARY OF THE INVENTION

In accordance with the present invention, there is provided a closure construction for a container which includes an inner closure cap, which is advantageously snap-fitted to a neck of a container and also to cover the rim thereof. The closure cap includes a central cylindrical portion, which forms an opening for the passage of material which is partially blocked by a stopper member which is captured in the cylindrical portion but which may be displaced upwardly and downwardly therein for varying the dispensing quantities. In addition a retaining ring is retained between a lip of a disc portion of the stopper in the cylindrical part of the inner closure cap. The construction also includes an outer closure cover which is adaptively threaded to the container, and which includes a shoulder portion which overlies and is adapted to bear against the inner closure cap at a location overlying the container rim. In addition, the outer cover has a depending stopper which engages into the cylindrical part of the inner closure cap and is advantageously shaped so as to have a wedging fit between the two parts.

Accordingly it is an object of the invention to provide an improved closure construction which includes an inner closure cap which is snappped and fastened to a container and which includes a central hoolow cylindrical part into which a stopper portion of an outer cover is interengaged when the cover is threaded onto the container.

A further object of the invention is to provide a closure, particularly for viscous substances, which includes a stopper pouring central part, which may be interengaged by a stopper element of an outer closure cap in order to maintain the surfaces clean and free of the liquid and to protect the exterior surface of the inner closure cap from contamination.

A further object of the invention is to provide a closure construction which is simple in design, rugged in construction and economical to manufacture.

DESCRIPTION OF THE PREFERRED EMBODIMENT

Figure 1:
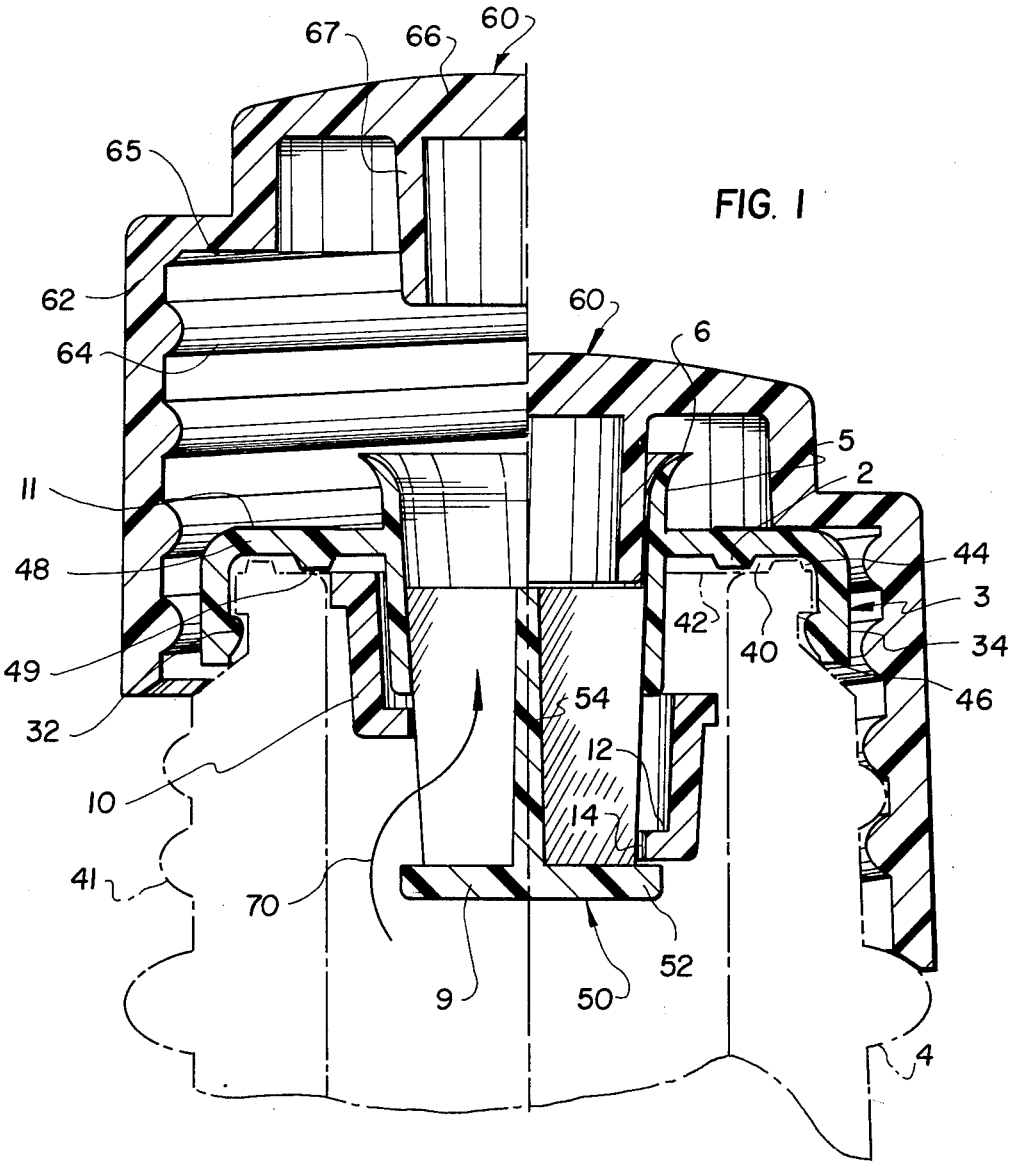
FIG. 1 is an axial sectional view showing two halfportions of a closure construction constructed in accordance with the invention, with the portion on the right hand side of the drawing showing the closed position, and the portion on the left hand side of the drawing showing a partly opened position.
Figure 2:
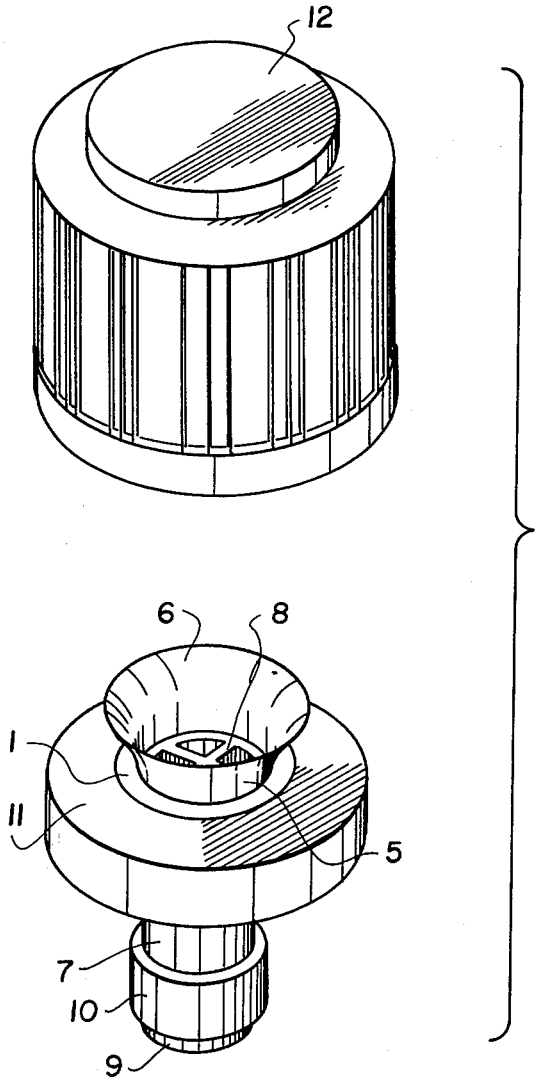
FIG. 2 is an exploded top perspective view of the inner closure cap and outer cover parts of the closure constructed in accordance with the invention.

Referring to the drawings in particular, the invention embodied therein, comprises a closure construction for a container such as a bottle 4, having a top rim 40 surrounding a central opening 42. Te rim 40 has a bead 44 and is provided with an encircling recess 46 below the bead 44 on its exterior for receiving and inwardly projecting bead or protuberance 32 of an inner closure cap generally designated 3. The inner closure cap 3 includes a skirt portion 34, which extends around the neck of the container adjacent to the rim 40 and a cap part 48 which overlies the rim and which includes an inwardly extending protuberance 49 which bears against an inner flat wall portion of the rim 40.

In accordance with a feature of the invention the inner closure cap 3 also carries a hollow cylindrical portion 5 which extends below the interior surface of the cap part 48 on the interior thereof and extends above the surface of the cap cover part 48 on the exterior. The exterior terminates in a necked flange 6 which is bevelled to a point. A floating stopper part generally designated 50 includes a flat disc bottom portion 52 and transversely or radially extending rib portions 54 which are bevelled outwardly and upwardly similar to the hollow cylindrical member 5. The upper circumferential dimension of the cross members 54 is larger than the internal diameter of the hollow cylindrical part 5, so that the floating stopper 52 becomes captured by the hollow cylindrical member. In addition a retaining ring 10 has a bottom portion with an inwardly directed flange part 12, with an opening 14 of a diameter large enough to permit movement of the ring 10 upwardly to the position indicated in the lefthand portion of the drawing of FIG. 1 or downwardly, retained on the disc 52 at the right-hand portion of FIG. 1.

The invention also includes an outer cover, generally designated 60, which includes a circumferential skirt portion 62, having internal threads 64 which engage with external threads 41 of the container 4. The outer cover includes a top cap ledge wall 65 which is adapted to bear against the top surface 11 of the cap part 48. In addition the outer cover 60 includes a central raised cap part 66 which has a depending, inwardly extending stopper projection 67, which is engageable into the hollow cylindrical part 5 when the outer cover is engaged over the container 4. The stopper part 67 is bevelled inwardly and downwardly similar to the bevelling of the hollow cylindrical part 5 but to a dimension such that there is a wedging interengagement of the parts when the outer cover is fully threaded onto the container 4.

When the outer cover 60 is removed from the container it is possible for the retaining ring 10 to be moved upwardly as shown to the left of the drawing in FIG. 1 to open a flow passage indicated by the arrow 70 upwardly between the cross members 54 of the floating stopper 50 to provide for a maximum outflow. When the ring 10 returns to the position indicated in the right-side of FIG. 1, the passage 70 is closed considerably.

What is claimed is:

1. A closure construction comprising a container having an externally threaded neck portion, with a top opening and a rim encircling the opening having an encircling cap bead receiving recess on the enterior thereof below said rim, an inner closure cap having a top cap part overying the container rim and a portion of the opening of the container and including an annular side skirt portion engaged around the exterior of said container neck portion, and with an inwardly extending cap bead engaged in a cap bead receiving recess of said container, said inner closure cap having a hollow cylindrical part extending through said top cap part and opening into the container and extending on the interior of said inner closure cap below the interior of said top cap part and extending on the exterior of said inner closure cap above the exterior of said top cap part, an outer cover having an internally threaded outer cover skirt part threadably engageable wih said internally threaded neck portion of said container, said outer cover having a top cap edge wall overlying said rim and engageable over said top cap part, said outer cover part also including a central raised cap part above said ledge wall overlying said hollow cylindrical part, and a stopper projection on the interior of said raised cap part engageable into said hollow cylindrical part, a floating stopper engaged in said hollow cylindrical part, having a bottom disc portion of a dimension greater than the diameter of the lower portion of said hollow cylindrical part, and a retaining ring having a flange engaged over said hollow disc portion, and being displaceable on said floating stopper, between said disc portion and the lower portion of said hollow cylindrical part.

2. A closure according to claim 1, wherein said stopper projection and said hollow cylindrical part are bevelled in dimensions so that said stopper projection becomes wedgingly engaged with said hollow cylindrical part.

3. A closure construction according to claim 1, wherein said floating stopper part includes radially extending walls which intersect centrally above said disc part.

4. A closure according to claim 3 wherein said retaining ring comprises a hollow ring member having a lower edge with an inwardly extending flange with a central opening of a diameter greater than the diameter of the lower portion of said hollow cylindrical part, and of the exterior of said radially extending walls of said floating stopper.

* * * * *